US005652555A

United States Patent [19]

Tada et al.

[11] Patent Number: 5,652,555

[45] Date of Patent: Jul. 29, 1997

[54] DIELECTRICAL FILTERS HAVING RESONATORS AT A TRAP FREQUENCY WHERE THE EVEN/ODD MODE IMPEDANCES ARE BOTH ZERO

[75] Inventors: Hitoshi Tada, Ishikawa-ken; Haruo Matsumoto; Hideyuki Kato, both of Kanazawa, all of Japan

[73] Assignee: Murata Manufacturing Co., Ltd., Kyoto, Japan

[21] Appl. No.: 438,493

[22] Filed: May 10, 1995

[30] Foreign Application Priority Data

Jun. 3, 1994 [JP] Japan ..... 6-122570
Jul. 7, 1994 [JP] Japan ..... 6-156074

[51] Int. Cl.[6] ..... H01P 1/205

[52] U.S. Cl. ..... 333/202; 333/206

[58] Field of Search ..... 333/202, 206, 333/202 DB

[56] References Cited

U.S. PATENT DOCUMENTS 5,374,910 12/1994 Yamagata ..... 333/206

FOREIGN PATENT DOCUMENTS 39901 2/1987 Japan ..... 333/202 DB
63-187901 8/1988 Japan ..... 333/202 DB
3-254201 11/1991 Japan ..... 333/202 DB
5-167308 7/1993 Japan ..... 333/206
5-167309 7/1993 Japan ..... 333/206
6-132706 5/1994 Japan ..... 333/202 DB

*Primary Examiner*—Benny Lee
*Attorney, Agent, or Firm*—Majestic, Parsons, Siebert & Hsue

[57] ABSTRACT

A compact dielectric band elimination filter, which is composed of fewer components and can be produced in fewer production steps, uses a resonator apparatus having a dielectric block with a plurality of throughholes each containing an inner conductor and serving as a resonator. Capacitor electrodes are formed on a main surface of the block such that series-connected resonant capacitors are provided with the inner conductors inside the throughholes. The resonator apparatus is mounted on a substrate of a layered structure having an inductor thereon. Each trap frequency of the filter associated with one of the resonators can be adjusted by making adjustments on the associated resonator without affecting the characteristics of the adjacent resonators, by forming a larger-diameter part and a smaller-diameter part separated by a step inside each throughhole or by using a dielectric block having a wider part and a narrower part through which throughholes with a uniform inner diameter are formed, such that the even-mode input impedance and odd-mode input impedance of each resonator will be equal to zero at the trap frequency associated therewith.

6 Claims, 7 Drawing Sheets

DIELECTRICAL FILTERS HAVING RESONATORS AT A TRAP FREQUENCY WHERE THE EVEN/ODD MODE IMPEDANCES ARE BOTH ZERO

BACKGROUND OF THE INVENTION

This invention relates to dielectric band elimination filters which use a dielectric resonator apparatus having series-connected resonant capacitors formed with a single dielectric block. This invention also relates to such filters, of which mutually adjacent pairs of resonators of the resonator apparatus do not couple at the trap frequencies.

Consider, for example, a dielectric band elimination filter which comprises two resonators and of which the equivalent circuit diagram is as shown in FIG. 13 wherein $R_1$ and $R_2$ are the two resonators, $C_{e1}$ and $C_{e2}$ are series-connected resonant capacitors of the resonators $R_1$ and $R_2$, and $\phi$ is a quarter-wavelength phase circuit. FIG. 14 is a similar equivalent circuit diagram of another dielectric band elimination filter which is different from the one shown by the diagram of FIG. 13 wherein the functions of the phase circuit are performed by an inductor L and stray capacitors $C_3$ and $C_4$. Components which are substantially identical to those shown in FIG. 13 are indicated in FIG. 14 by the same symbols.

A dielectric filter having such an equivalent circuit diagram has conventionally been produced, as shown in FIG. 15, by using two each of discrete resonators $R_1$ and $R_2$, series-connected capacitors $C_{e1}$ and $C_{e2}$ and connector terminals 82*a* and 82*b*, together with a substrate 80, a shield cover 81 and either a coil $L_1$ or a printed inductor $L_2$.

Prior art dielectric band elimination filters have many components to assemble for the production, requiring many production steps, and are difficult to make compact because the numbers of resonators, capacitors and connector terminals increase in proportion to the number of stages. It is therefore an object of this invention to provide a compact dielectric band elimination filter with a reduced number of component parts which can be assembled in a reduced number of production steps.

Consider, next, another band elimination filter, of which the equivalent circuit diagram is as shown in FIG. 16, including three resonators $R_1$, $R_2$, $R_3$, three series-connected resonant capacitors $C_e$, three stray capacitors $C_s$ and two connecting inductors $L_1$ and $L_2$. If such a filter is built by using three discrete resonators $R_1$–$R_3$, as conventionally done, there is a one-to-one correspondence established between the individual resonant frequencies of these discrete resonators $R_1$–$R_3$ and the trap frequencies after the band elimination filter has been constructed. In other words, adjacent resonators do not affect characteristics of each other.

If a filter, shown by the equivalent circuit diagram of FIG. 16, is built with three resonators unistructurally formed inside a single dielectric block, there may no longer be a one-to-one correspondence between the resonant frequencies of the individual resonators and the trap frequencies of the completed band elimination filter. This lack of correspondence is illustrated in FIG. 17 wherein the solid line indicates the original band elimination characteristic having three trap frequencies corresponding to the three resonators. If the length of one of the resonators is changed such that its trap (attenuation pole) frequency is changed from $f_1$ on this solid line to $f_2$, the trap frequencies of the other two resonators in the block are thereby affected and also undergo changes, and the trap characteristic may look as shown by the broken line in FIG. 17.

Accordingly, it has been difficult to individually adjust the characteristics of the resonators thus formed, and practically usable band-elimination filters of this type could not be produced. This was because both even and odd modes of oscillations are generated inside the dielectric block such that mutually adjacent pairs of the resonators are coupled to each other, affecting performance characteristics of each other.

It is therefore another object of this invention to provide a dielectric filter of the type having a plurality of resonators formed inside a single dielectric block, of which the trap frequencies can be adjusted independently, without affecting the characteristics of the adjacent resonators.

SUMMARY OF THE INVENTION

A dielectric band elimination filter according to this invention, with which the first of the aforementioned objects can be accomplished, may be characterized as comprising a dielectric resonator apparatus formed with a single dielectric block having a plurality of throughholes therethrough. Inner conductors are provided in these throughholes so as to function as resonators. One of the end surfaces of the block serves as an open end surface, and capacitor electrodes are formed on an outer surface of the block near the open end surface, corresponding to the throughholes. The outer surfaces of the block are substantially entirely covered by an outer conductor except on the open end surface and around the capacitor electrodes such that series-connected resonant capacitors are formed between the inner conductors inside the throughholes and the capacitor electrodes. The block thus formed is mounted on a substrate, on which are formed capacitor-connecting electrodes connected to the capacitor electrodes formed on the dielectric block, inductor-connecting lands connected to these capacitor-connecting electrodes, an inductor set between these inductor-connecting lands, and input/output electrodes connected to and led from these inductor-connecting lands.

According to another embodiment of the invention, the inner surfaces of the throughholes through the dielectric block have an annular conductor-free area near one of its openings to serve as an open end of the resonator. The outer conductor covers not only both end surfaces but also protrude a little into the throughholes towards the annular conductor-free areas.

Such filters have fewer component parts and hence can be made compact in fewer production steps.

A dielectric band elimination filter according to this invention, with which the second of the aforementioned objects can be accomplished, may be characterized as comprising a dielectric block having a plurality of resonators each formed as a throughhole therethrough and having a larger-diameter part and a smaller-diameter part separated by a step. Each resonator, thus formed, provides a trap frequency $f_t$ with a series-connected resonant capacitor and is characterized wherein its even-mode input impedance $Z_{in(e)}$ and odd-mode input impedance $Z_{in(o)}$ are both zero at the trap frequency $f_t$. As a variation to the above, the throughholes may be straight and of a uniform inner diameter throughout, having no steps inside, while the outer side surfaces of the block have steps between a wider part and a narrower part of the block. The aforementioned series-connected resonant capacitors may be provided outside or inside the dielectric block. One of the end surfaces of the dielectric block where the resonator-providing throughholes are open may serve as an open end surface, no outer conductor being formed thereon, or each through-hole may be provided with an annular conductor-free area near one of its openings so as to provide an open end to the resonator inside the throughhole.

With a dielectric resonator thus structured, each resonator can be independently adjusted without affecting the characteristics of the adjacent ones of the resonators at the same time. When the aforementioned conditions are satisfied relating to the even-mode input impedance and odd-mode input impedance, the even-mode trap frequency $f_{t(e)}$ and the odd-mode trap frequency $f_{t(o)}$ become equal to each other.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 1:
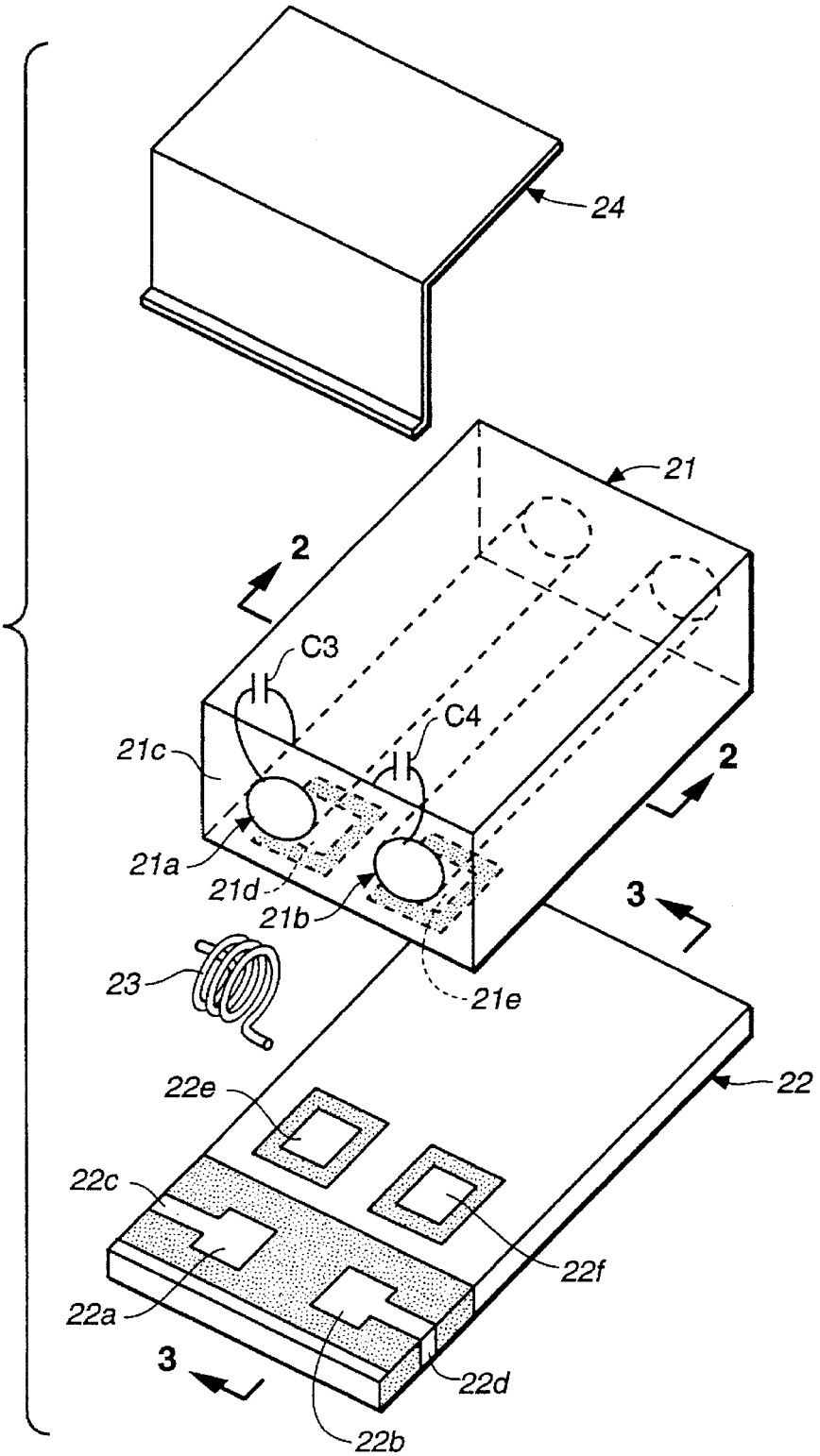
FIG. 1 is an exploded diagonal view of a dielectric band elimination filter embodying the present invention.

As shown in FIG. 1, a dielectric band elimination filter according to this invention makes use of a resonator apparatus 21 comprising a dielectric block through which two throughholes 21*a* and 21*b* are formed to provide two resonators. Inner conductors are formed inside these throughholes, and capacitor electrodes 21*d* and 21*e* are formed on the bottom surface of the resonator apparatus 21 near its open end surface 21*c* and corresponding respectively to the throughholes 21*a* and 21*b*, as can also be seen in FIG. 2. The outer surfaces of the resonator apparatus 21 is nearly completely covered by an outer conductor, except on the open end surface 21*c* and surrounding areas of the capacitor electrodes 21*d* and 21*e*. Series-connected resonant capacitors $C_{e1}$ and $C_{e2}$ are formed between the capacitor electrodes 21*d* and 21*e* (although not shown in FIG. 1) and the inner conductors inside the throughholes 21*a* and 21*b*. On the side of the open end surface 21*c*, stray capacitors $C_3$ and $C_4$ are formed between end parts of the throughholes $\mathbf{21}_a$ and 21*b* and the outer conductor, as shown in FIG. 1 (but not shown in FIG. 2).

Figure 3:
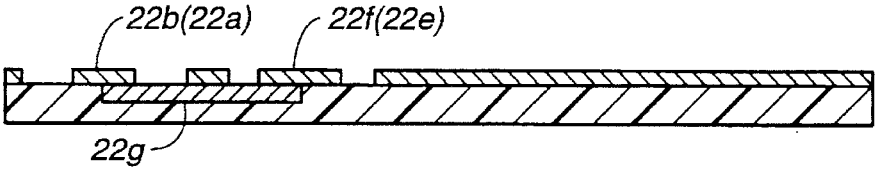
FIG. 3 is a sectional view of the substrate shown in FIG. 1 taken along line 3—3.

In FIG. 1, numeral 22 indicates a substrate of a multilayered structure, on the upper surface of which are provided coil-connecting lands 22*a* and 22*b*. Input/output electrodes 22*c* and 22*d* are also provided, connected to these coil-connecting lands 22*a* and 22*b* and reaching the lower surface of the substrate 22 over its side surfaces, and a coil inductor 23 is connected to the coil-connecting lands 22*a* and 22*b*. Capacitor-connecting electrodes 22*e* and 22*f* are further provided on the upper surface of the substrate 22 and connected to the capacitor electrodes 21*d* and 21*e* of the resonator apparatus 21. The coil-connecting land 22*b* and the capacitor-connecting electrode 22*f* are electrically connected, as shown in FIG. 3, by a shorting electrode 22*g* which forms an intermediate layer of the substrate 22. The coil-connecting land 22*a* and the capacitor-connecting electrode 22*e* are similarly connected electrically. The substrate 22 is substantially entirely covered by a grounding electrode except the areas where the coil-connecting lands 22*a* and 22*b* and the input-output electrodes 22*c* and 22*d* are formed and the areas surrounding the capacitor-connecting electrodes 22*e* and 22*f*. In FIG. 1, numeral 24 indicates a shield cover.

Figure 4:
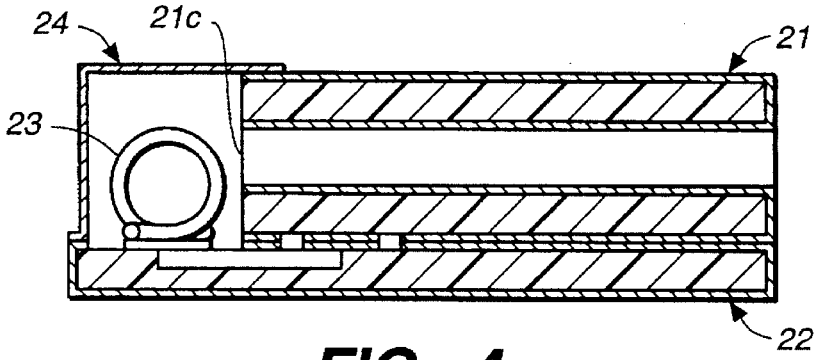
FIG. 4 is a sectional view of the dielectric band elimination filter of FIG. 1 when it is assembled.

The components shown in FIG. 1 are assembled together as shown in FIG. 4. The coil inductor 23 is connected to the coil-connecting lands 22*a* and 22*b*, (not explicitly shown herein), and the capacitor electrodes 21*d* and 21*e* of the resonator apparatus 21 are connected respectively to the capacitor-connecting electrodes 22*e* and 22*f* (not explicitly shown herein), of the substrate 22. The outer conductor of the resonator apparatus 21 is connected to the grounding electrode of the substrate 22. The shield cover 24 is set on the side of the open end surface 21*c* of the resonator apparatus 21 and covers the coil inductor 23.

Figure 14:
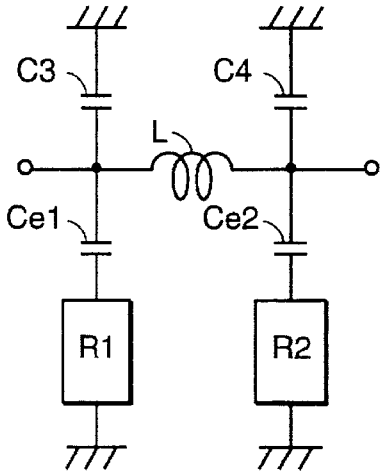
FIG. 14 (PRIOR ART)
FIG. 14 is another general equivalent circuit diagram of a dielectric filter.

The filter described above with reference to FIGS. 1–4 has an equivalent circuit diagram as shown in FIG. 14 but since the series-connected resonant capacitors $C_{e1}$ and $C_{e2}$ are formed between the inner conductors of the throughholes 21*a* and 21*b* and the capacitor electrodes 21*d* and 21*e*, there is no need to provide discrete capacitor units, and this means that the connector terminals in prior art filters can also be dispensed with and that compact filters can be provided according to this invention.

Figure 5:
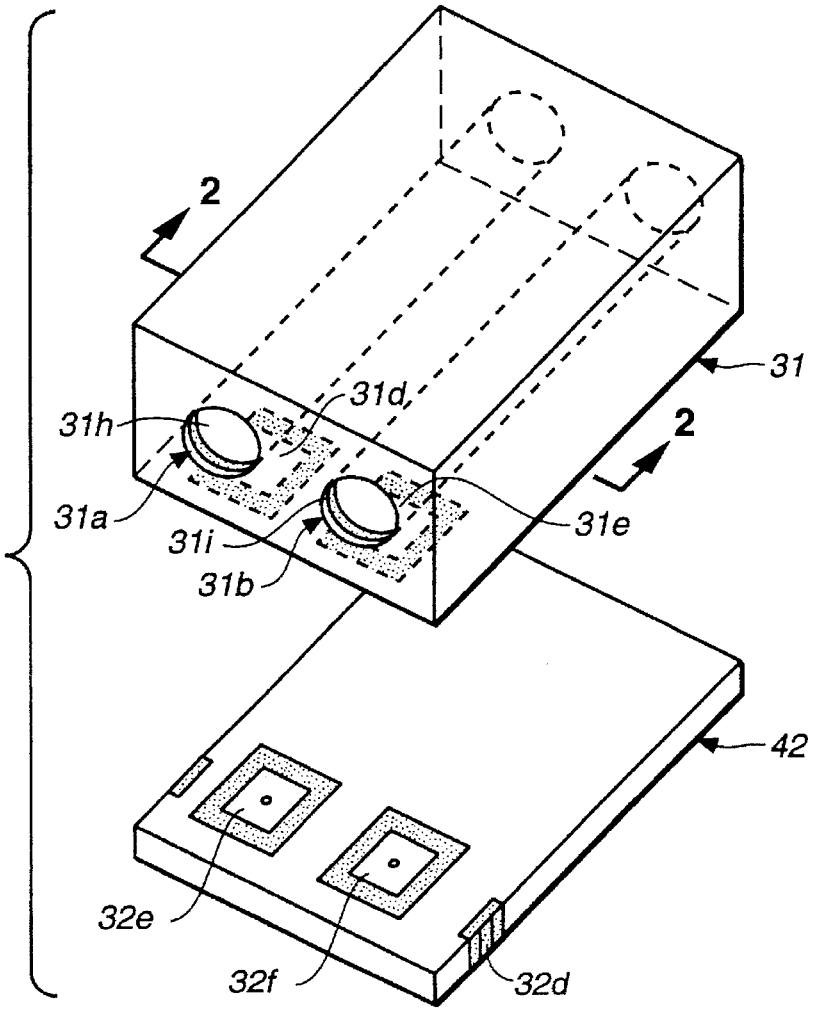
FIG. 5 is an exploded diagonal view of another dielectric band elimination filter embodying this invention.

FIG. 5 shows another embodiment of this invention, of which the equivalent circuit diagram is as shown in FIG. 14, using a block resonator apparatus 31 having two throughholes 31*a* and 31*b* which serve as two resonators. Inner conductors are provided inside these throughholes 31*a* and 31*b* except annular conductor-free areas 31*h* and 31*i*, where the dielectric material of the block is exposed. The annular conductor-free areas 31*h* and 31*i* are provided near the openings of the throughholes 31*a* and 31*b*, serving as open ends of the two resonators.

Capacitor electrodes 31*d* and 31*e* are formed, as in the first embodiment of the invention described above, on the bottom surface of the resonator apparatus 31 near the open ends of the resonators corresponding to the two throughholes 31*a* and 31*b*. The outer surfaces of the resonator apparatus 31 are nearly completely covered by an outer conductor, except areas surrounding the capacitor electrodes 31*d* and 31*e*. The outer conductor penetrates into the throughholes 31*a* and 31*b* by a short distance.

Figure 2:
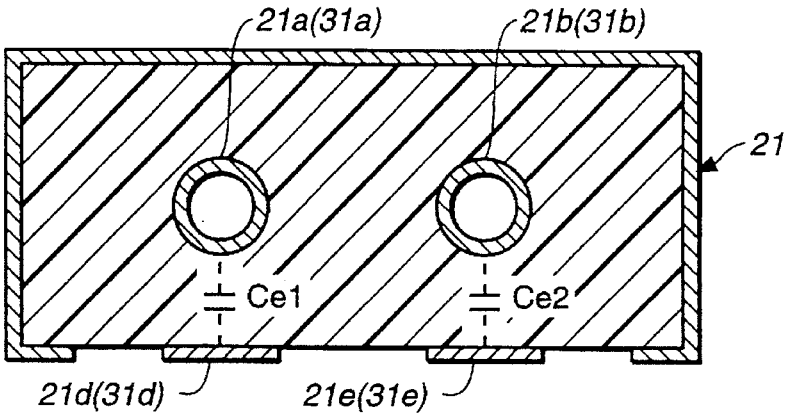
FIG. 2 is a sectional view taken along line 2—2 in FIG. 1, as well as FIG. 5.

With a resonator apparatus thus structured, series-connected resonant capacitors $C_{e1}$ and $C_{e2}$ are formed, as shown in FIG. 2 for the embodiment of the invention described with reference to FIG. 1, between the capacitor electrodes 31*d* and 31*e* and the inner conductors of the throughholes 31*a* and 31*b*, respectively. Stray capacitors $C_3$ and $C_4$, as shown in FIG. 14, are also formed between the inner and outer conductors across the annular conductor-free areas 31*h* and 31*i* near the openings of the throughholes 31*a* and 31*b*.

Figure 7:
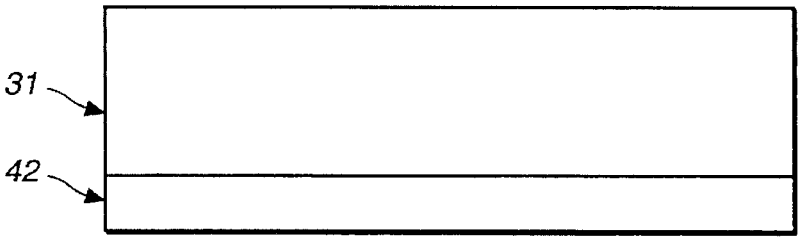
FIG. 7 is an external side view of the filter shown in FIG. 5 in an assembled form.
Figure 6:
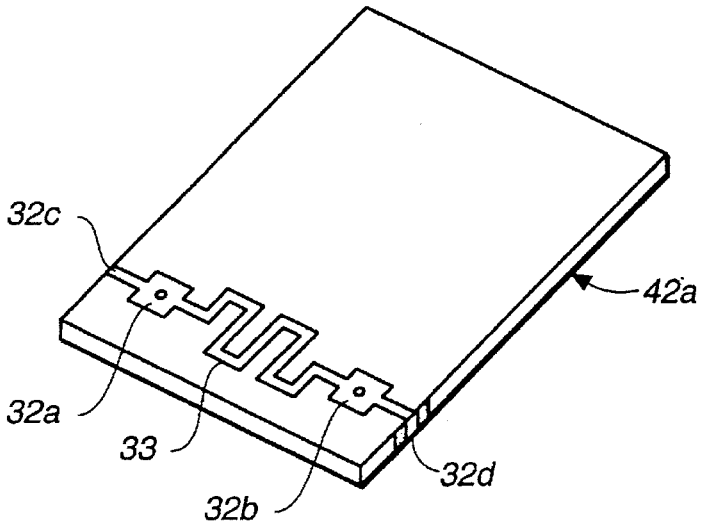
FIG. 6 is a diagonal view of an intermediate layer of the substrate shown in FIG. 5.

In FIG. 5, numeral 42 indicates a substrate of a multi-layered structure, on the upper surface of which are provided capacitor-connecting electrodes 32*e* and 32*f* near one of its edges separate from grounding electrode. An intermediate layer 42*a*, separately shown in FIG. 6, of the substrate 42 has formed thereon a pattern inductor 33, inductor-connecting lands 32*a* and 32*b* therefor and input/output electrodes 32*c* and 32*d* which are connected to the inductor-connecting lands 32*a* and 32*b* and reach the bottom surface of this intermediate layer 42*a* over its side surfaces. The capacitor-connecting electrodes 32*e* and 32*f* and the inductor-connecting lands 32*a* and 32*b* are electrically connected through throughholes. The outer surfaces of the substrate 42 are substantially entirely covered by a grounding electrode except on areas surrounding the capacitor-connecting electrodes 32*e* and 32*f* and the input/output electrodes 32*c* and 32*d*. The resonator apparatus 31 and the substrate 42 of FIG. 5 are joined together to form a single unit, as shown in FIG. 7, with the capacitor electrodes 31*d* and 31*e* connected to the capacitor-connecting electrodes 32*e* and 32*f* and the outer conductor of the resonator apparatus 31 connected to the grounding electrode over the substrate 42 (not explicitly shown herein). This embodiment of the invention is advantageous in that the leakage of electromagnetic fields can be reduced because the open ends of the resonators are near the openings of the throughholes of the resonators. As a result, the shield cover 24 in the first embodiment of the invention can be dispensed with. If the substrate 42 and the resonator apparatus 31 are of the same size, as shown in FIG. 7, the filter can be made even more compact.

Figure 8:
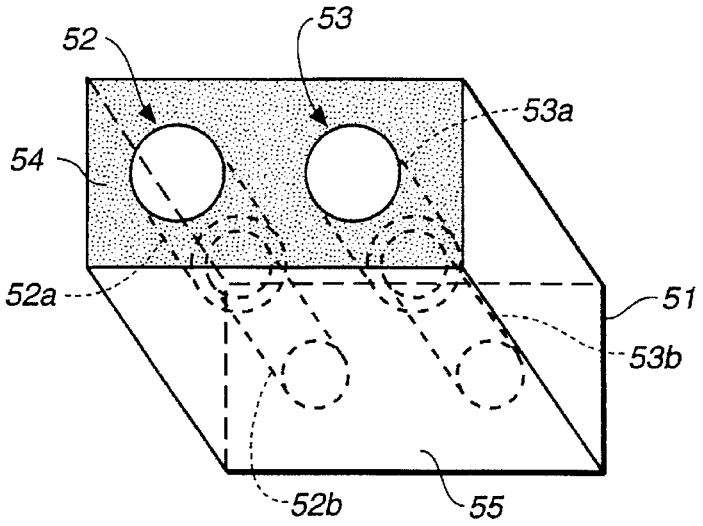
FIG. 8 is a diagonal view of still another dielectric filter according to this invention.

FIG. 8 shows still another dielectric filter embodying the present invention also comprising a dielectric block 51 which has a plurality of resonators (two in this example shown at 52 and 53) formed therein. These resonators 52 and 53 are characterized as being formed inside throughholes having steps which separate larger-diameter parts 52*a* and 53*a* and smaller-diameter parts 52*b* and 53*b* of the throughholes. The larger-diameter parts 52*a* and 53*a* are formed on the side of the open end surface 54 of the block 51, and the smaller-diameter parts 52*b* and 53*b* are formed on the side of the shorted end surface 55 of the block 51. The outer surfaces of the dielectric block 51 are entirely covered by an outer conductor except on the open end surface 54. Inner conductors formed inside the throughholes are connected to the outer conductor on the shorted end surface 55.

Figure 9:
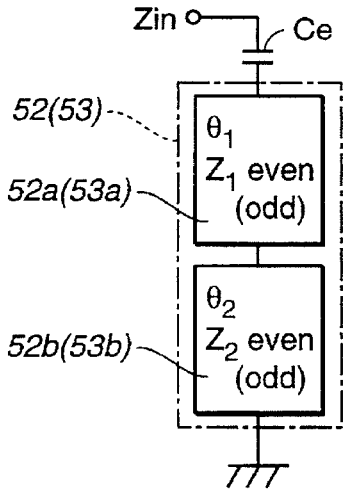
FIG. 9 is a portion of an equivalent circuit diagram of the dielectric filter of FIG. 8.
Figure 16:
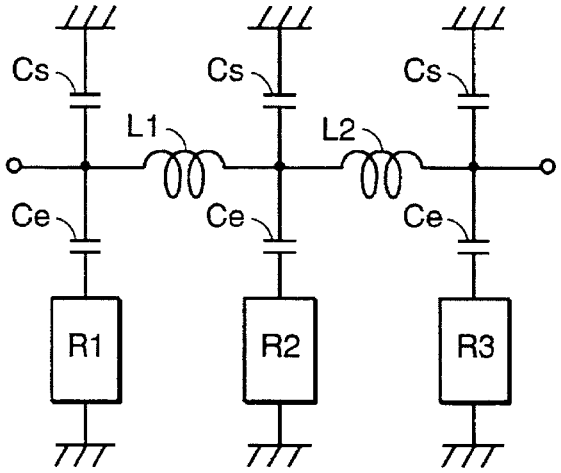
FIG. 16 (PRIOR ART)
FIG. 16 is still another general equivalent diagram of a dielectric filter.
Figure 17:
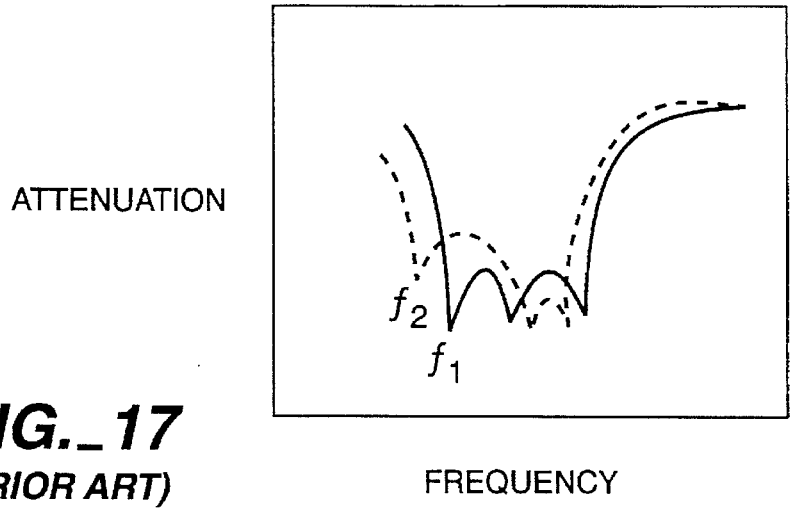
FIG. 17 (PRIOR ART)
FIG. 17 is an attenuation-frequency diagram of a prior art dielectric band elimination filter.
Figure 15:
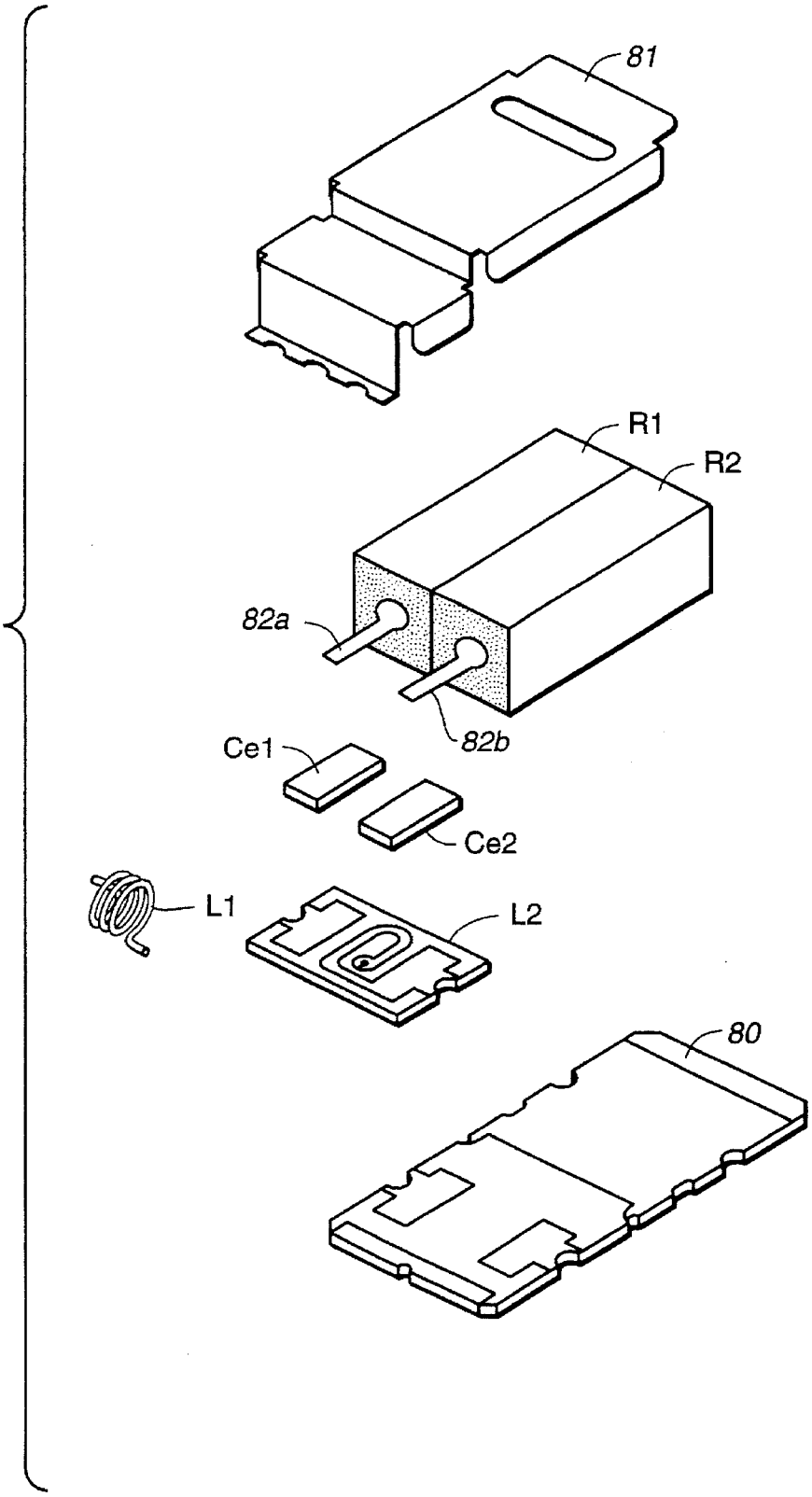
FIG. 15 (PRIOR ART)
FIG. 15 is an exploded diagonal view of a prior art dielectric filter.

FIG. 9 is a portion of an equivalent circuit diagram of the dielectric filter shown in FIG. 8, showing either of the two resonators 52 and 53 inside the dotted line. Capacitor corresponding to the stray capacitor $C_s$ shown in FIG. 16 is omitted for convenience from FIG. 9. As shown in FIG. 9, each of the two resonators 52 and 53 is adapted to undergo series resonance with a series-connected resonant capacitor $C_e$, and its resonant frequency represents one of the trap frequencies of the filter.

With reference to the portion of the equivalent circuit diagram, let $C_e$ also indicate the capacitance of the aforementioned series-connected resonant capacitor, $\theta_1$ and $\theta_2$ respectively the phase angle of the larger-diameter and the smaller-diameter parts of the throughhole 52*a* or 53*a* and 52*b* or 53*b*, and $Z_1$ even(odd) and $Z_2$ even(odd) respectively the characteristic impedance of the larger-diameter and the smaller-diameter parts of the through-hole 52*a* or 53*a* and 52*b* or 53*b* for even (odd) mode. Then, the input impedance in the even and odd modes $Z_{in(e)}$ and $Z_{in(o)}$ is given as follows:

$$Z_{in(e)}=jZ_{1e}(Z_{1e}\tan\theta_1+Z_{2e}\tan\theta_2)/(Z_{1e}-Z_{2e}\tan\theta_1\tan\theta_2)+1/j\omega C_e$$

and $$Z_{in(o)}=jZ_{1o}(Z_{1o}\tan\theta_1+Z_{2o}\tan\theta_2)/(Z_{1o}-Z_{2o}\tan\theta_1\tan\theta_2)+1/j\omega C_e$$

where $\omega$ is the angular frequency.

Figure 10:
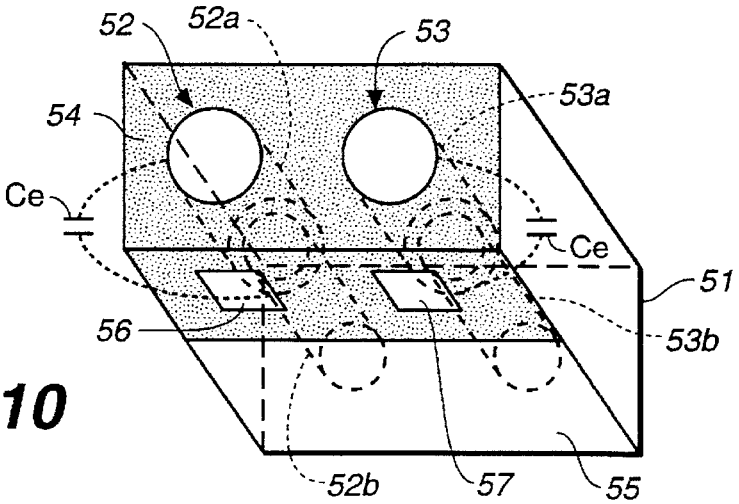
FIG. 10 is a diagonal view of still another dielectric filter according to this invention.
Figure 11:
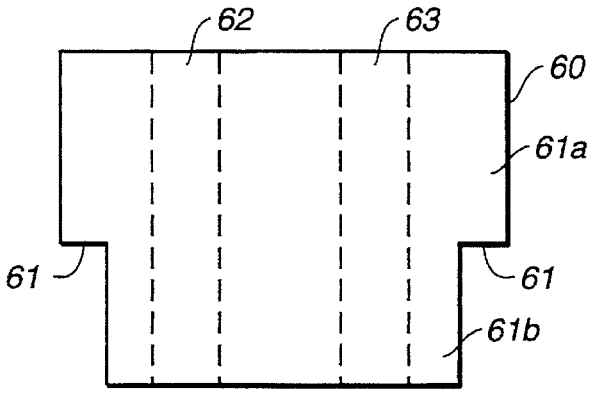
FIG. 11 is a plan view of still another dielectric filter according to this invention.
Figure 12:
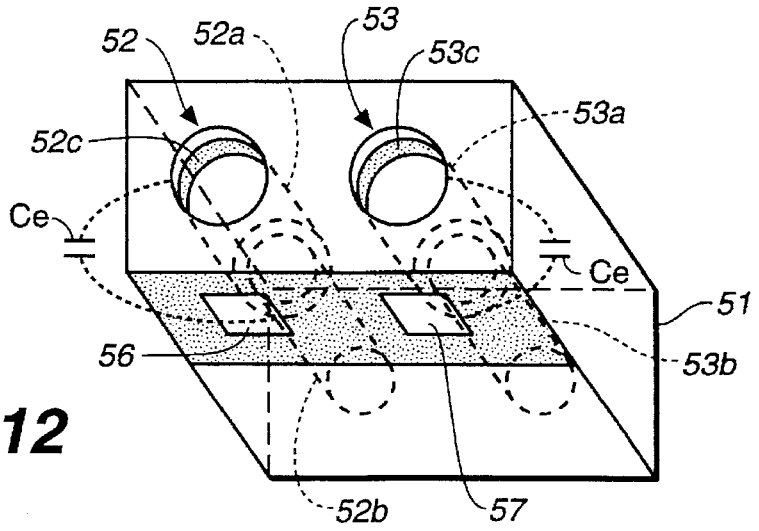
FIG. 12 is a diagonal view of still another dielectric filter according to this invention.
Figure 13:
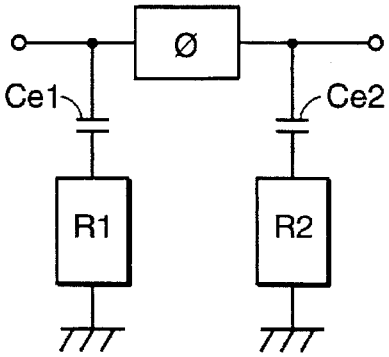
FIG. 13 (PRIOR ART)
FIG. 13 is a general equivalent circuit diagram of a dielectric filter.

A filter according to this invention is characterized as satisfying the condition $Z_{in(e)}=Z_{in(o)}=0$ when the frequency is equal to a trap frequency $f_r$. As a result, there is a one-to-one correspondence between the resonant frequency of one of the resonators of the dielectric resonator apparatus and the trap frequency of the band elimination filter which has been formed therewith. Thus, even if a physical characteristic of one of the resonators is changed to thereby change the trap frequency corresponding thereto, the trap frequency of the neighboring resonator adjacent thereto is not thereby affected. In this situation, furthermore, the even-mode trap frequency $f_{r(e)}$ and the odd-mode trap frequency $f_{r(o)}$ become equal to each other. Although FIG. 8 shows a filter with only two resonators, this is not intended to limit the scope of the invention. FIGS. 10–12 show other dielectric filters according to the present invention satisfying the condition described above. Components which are equivalent or at least similar in these figures are indicated by the same numerals for convenience and are not repetitively explained although belonging to different filters.

The dielectric filter shown in FIG. 10 is similar to that shown in FIG. 8 but is characterized as having capacitor electrodes 56 and 57 formed on the bottom surface of the dielectric resonator apparatus at positions corresponding to the larger-diameter parts 52*a* and 53*a* of the throughholes, electrically insulated from the outer conductor by conductor-free areas where the dielectric material is exposed, such that series-connected resonant capacitors $C_e$, as shown in the equivalent circuit diagram of FIG. 9, are formed between these capacitor electrodes 56 and 57 and the inner conductors inside the large-diameter parts 52*a* and 53*a*, respectively.

The dielectric filter shown in FIG. 11 is characterized wherein the dielectric block 60 of its dielectric resonator apparatus has a wider part 61*a* and a narrower part 61*b* separated by steps 61 on both side surfaces. A plurality of resonators (two in the illustrated example shown at 62 and 63) are formed by throughholes with a uniform diameter. The outer surfaces of the block 60 is mostly covered by an outer conductor except on the end surface on the side of the wider part 61*a* which serves as an open end surface. The steps 61 on the external side surfaces of the dielectric block 60 have the same functions as the steps in the inner surfaces of the throughholes in the embodiments of this invention described above with reference to FIGS. 8 and 10.

The dielectric filter shown in FIG. 12 is similar to that described above with reference to FIG. 10 but is characterized as having conductor-free areas 52*c* and 53*c* near the openings of the larger-diameter parts 52*a* and 53*a* of the throughholes to serve as open ends of the resonators 52 and 53. Consequently, the open end surface 54 (not labelled herein) according to this embodiment of the invention is covered by the outer conductor as well as the other outer surfaces of the block 51. In other aspects, the filter according to this embodiment is substantially the same as that shown in FIG. 10, and hence equivalent or similar components are indicated by the same numbers in these figures.

In summary, a plurality of resonators are formed inside a dielectric block either by providing throughholes with a larger-diameter part and a smaller-diameter part separated by a step or by providing throughholes with a uniform diameter but forming steps on the side surfaces of the block between a wider part and a narrower part of the block. These resonators are characterized wherein the even-mode input impedance and the odd-mode input impedance are both zero at their trap frequencies. In this way, there is no coupling between mutually adjacent pairs of resonators such that the trap frequency of each resonator can be independently adjusted without affecting the characteristics of the neighboring resonators.

What is claimed is:

1. A dielectric filter comprising:

a dielectric block having a plurality of inner conductors serving as resonators in throughholes through said dielectric block, each of said throughholes having a larger-diameter part and a smaller-diameter part separated by a step therebetween; and capacity electrodes each associated and forming one of series-connected resonant capacitors with a different one of said resonators;

each of said resonators having a respective trap frequency with an associated one of said series-connected resonant capacitors, both even-mode input impedance and odd-mode input impedance of each of said resonators being zero at said trap frequency.

2. The dielectric filter of claim 1 wherein said dielectric block has an open end surface, each of said resonators having an open end at said open end surface.

3. The dielectric filter of claim 1 wherein each of said throughhole has a conductor-free area, each of said resonator having an open end at said conductor-free area.

4. A dielectric filter comprising:

a dielectric block having a plurality of inner conductors inside straight throughholes with a uniform inner diameter formed therethrough and to serve as resonators, said block having a wider part and a narrower part, said throughholes being formed through both said wider and narrower parts, said block having steps on outer side surfaces between said wider and narrower parts; and capacity electrodes each associated and forming one of series-connected resonant capacitors with a different one of said resonators; each of said resonators having a respective trap frequency with an associated one of said series-connected resonant capacitors, both even-mode input impedance and odd-mode input impedance of each of said resonators being zero at said trap frequency.

5. The dielectric filter of claim 4 wherein said dielectric block has an open end surface, each of said resonators having an open end at said open end surface.

6. The dielectric filter of claim 4 wherein each of said throughhole has a conductor-free area, each of said resonator having an open end at said conductor-free area.

* * * * *